US012593928B2

(12) United States Patent
Duncan et al.

(10) Patent No.: US 12,593,928 B2
(45) **Date of Patent: *Apr. 7, 2026**

(54) SPRING MODULES FOR AN ADJUSTABLE SLEEPING SYSTEM

(71) Applicant: SLEEP TECHNOLOGIES, LLC, Harlingen, TX (US)

(72) Inventors: Robert B. Duncan, Harlingen, TX (US); Matthew Hayward, Richardson, TX (US); Christopher S. Thompson, Combine, TX (US); Matthew E. Griffey, Waco, TX (US); Kim K. Jensen, Las Vegas, NV (US); Peter A. Bermudez, Little Compton, RI (US)

(73) Assignee: Sleep Technologies, LLC, Harlingen, TX (US)

( * ) Notice: Subject to any disclaimer, the term of this patent is extended or adjusted under 35 U.S.C. 154(b) by 291 days.

This patent is subject to a terminal disclaimer.

(21) Appl. No.: 18/217,450

(22) Filed: Jun. 30, 2023

(65) Prior Publication Data

US 2024/0000238 A1 Jan. 4, 2024

Related U.S. Application Data

(60) Provisional application No. 63/357,929, filed on Jul. 1, 2022.

(51) Int. Cl.
*A47C 27/06* (2006.01)

(52) U.S. Cl.
CPC ..... *A47C 27/061* (2013.01); *A47C 27/064* (2013.01)

(58) Field of Classification Search
CPC .... A47C 27/061; A47C 27/064; A47C 27/063
See application file for complete search history.

(56) References Cited

U.S. PATENT DOCUMENTS 6,433 A 5/1849 Webster
12,111 A 12/1854 Wright
(Continued)

FOREIGN PATENT DOCUMENTS

CA 1265262 A 1/1990
CA 65629 S 3/1990
(Continued)

OTHER PUBLICATIONS

Excel Medical Supplies, "Alternating Pressure and Continuous Low Air Loss Relief", Published Apr. 1, 2014, Retrieved from internet on May 26, 2016, 1 page.
(Continued)

*Primary Examiner* — Myles A Throop
(74) *Attorney, Agent, or Firm* — Dickinson Wright PLLC; Kristopher Lance Anderson; Damian M. Aquino

(57) ABSTRACT

Spring modules for an adjustable sleeping system. At least some of the example embodiments are spring modules comprising: a spring rail, and a plurality of adjustable spring assemblies spaced along the length of the spring rail. Each adjustable spring assembly may comprise: a motor with a stator coupled to the spring rail via a load cell, a lead screw coupled to a rotor of the motor, and the lead screw extending above an upper surface of the spring rail, a spring plate coupled to the lead screw, and a main spring coupled to the spring plate. A tubular sock disposed over the main spring, and a compliant insert can be disposed between adjacent main springs to inhibit side loading and maintain the main spring in upright relation with the spring rail.

28 Claims, 9 Drawing Sheets

(56) References Cited

U.S. PATENT DOCUMENTS 82,457 A 9/1868 Ward et al.
118,351 A 8/1871 Dunaway
207,776 A 9/1878 Roswall
218,927 A 8/1879 Bury
277,541 A 5/1883 Bowers
322,382 A 7/1885 Keith
414,292 A 11/1889 Clevett
656,411 A 8/1900 Leggett
729,021 A 5/1903 Cise et al.
754,097 A 3/1904 Shannon
977,253 A 11/1910 Ade
1,276,760 A 8/1918 Hines
2,112,702 A 3/1938 Loibl
2,314,361 A 3/1943 Meutsch
2,315,706 A 4/1943 Hopkes
2,558,288 A 6/1951 Backus
2,595,072 A 4/1952 Gottschalk
2,630,585 A 3/1953 Reese
3,088,132 A 5/1963 Vogel
3,656,190 A 4/1972 Regan et al.
4,175,549 A 11/1979 Hamer
4,222,137 A 9/1980 Usami
4,597,118 A 7/1986 Mis
4,644,593 A 2/1987 O'Brien
4,644,597 A 2/1987 Walker
4,745,644 A 5/1988 Pottschmidt
4,766,597 A 8/1988 Olshansky
4,766,628 A 8/1988 Walker
4,788,729 A 12/1988 Walker
4,799,276 A 1/1989 Kadish
D300,194 S 3/1989 Walker
4,890,344 A 1/1990 Walker
4,897,890 A 2/1990 Walker
4,908,895 A 3/1990 Walker
4,991,244 A 2/1991 Walker
5,144,706 A 9/1992 Walker
5,170,522 A 12/1992 Walker
5,170,552 A 12/1992 Swiderski et al.
5,305,738 A 4/1994 Shimizu
5,509,154 A 4/1996 Shafer et al.
5,523,040 A 6/1996 Krouskop
5,542,907 A 8/1996 Chou
5,553,836 A 9/1996 Ericson
5,564,140 A 10/1996 Shoenhair et al.
5,625,914 A 5/1997 Schwab
5,642,546 A 7/1997 Shoenhair
5,904,172 A 5/1999 Gifft et al.
6,098,223 A 8/2000 Larson
6,146,342 A 11/2000 Glen
6,161,231 A 12/2000 Kraft et al.
6,202,239 B1 3/2001 Ward et al.
6,219,863 B1 4/2001 Loberg et al.
6,397,419 B1 6/2002 Mechache
6,471,197 B1 10/2002 Denk et al.
6,487,738 B1 12/2002 Graebe
6,560,804 B2 5/2003 Wise et al.
6,625,827 B1 9/2003 Polevoy et al.
6,686,711 B2 2/2004 Rose et al.
6,708,357 B2 3/2004 Gaboury et al.
6,721,981 B1 4/2004 Greenhalgh et al.
6,763,541 B2 7/2004 Mahoney et al.
6,804,848 B1 10/2004 Rose
6,832,397 B2 12/2004 Gaboury et al.
6,883,191 B2 4/2005 Gaboury et al.
7,069,610 B1 7/2006 Chai
7,107,642 B2 9/2006 Wong et al.
7,270,222 B1 9/2007 Aymar
7,676,872 B2 3/2010 Block et al.
7,856,895 B2 12/2010 Syassen
7,865,988 B2 1/2011 Koughan et al.
7,934,277 B1 5/2011 Shu
7,941,882 B1 5/2011 Strozer
8,328,287 B2 12/2012 Hsu
8,341,786 B2 1/2013 Oexman et al.
D698,338 S 1/2014 Ingham et al.
8,672,842 B2 3/2014 Kenalty et al.
8,672,853 B2 3/2014 Young
8,752,222 B2 6/2014 Papaioannou
8,769,747 B2 7/2014 Mahoney et al.
8,844,079 B2 9/2014 Skinner et al.
8,844,943 B2 9/2014 Kim et al.
8,973,183 B1 3/2015 Palashewski et al.
9,131,782 B1 9/2015 Baker
9,138,065 B2 9/2015 Chandler
9,314,386 B1 4/2016 Boyd
9,836,930 B2 12/2017 De Luca
9,924,813 B1 3/2018 Basten et al.
9,933,775 B2 4/2018 Saavedra
9,955,795 B2 5/2018 Krenik
10,010,187 B1 7/2018 Mencia
10,334,957 B2 7/2019 Edling et al.
10,416,031 B2 9/2019 Hsu et al.
10,561,253 B2 2/2020 Tsern et al.
10,588,420 B1 3/2020 Krenik
11,021,029 B2 6/2021 Harrison
2002/0184711 A1 12/2002 Mahoney et al.
2004/0231057 A1* 11/2004 Sabin ..... A47C 23/002 5/717
2005/0204475 A1 9/2005 Schmitz et al.
2005/0235417 A1 10/2005 Koughan et al.
2005/0257883 A1 11/2005 Anagnostopoulos
2006/0253994 A1 11/2006 Sprinks et al.
2008/0035156 A1 2/2008 Hyde et al.
2008/0052830 A1 3/2008 Koughan et al.
2008/0052837 A1 3/2008 Blumberg
2008/0077020 A1 3/2008 Young et al.
2008/0276377 A1 11/2008 Hsu
2009/0038080 A1 2/2009 Grigg
2010/0043148 A1 2/2010 Rose et al.
2010/0170043 A1 7/2010 Young et al.
2010/0174198 A1 7/2010 Young et al.
2010/0174199 A1 7/2010 Young et al.
2010/0218315 A1 9/2010 Hyde et al.
2010/0257675 A1 10/2010 Demoss
2010/0325810 A1 12/2010 Dahlin et al.
2011/0010014 A1 1/2011 Oexman et al.
2011/0144455 A1 6/2011 Young et al.
2011/0296621 A1 12/2011 Mckenna
2011/0296622 A1 12/2011 Hsu
2011/0314612 A1 12/2011 Hsu
2012/0042454 A1 2/2012 Viberg
2012/0056458 A1 3/2012 Hsu
2012/0110744 A1 5/2012 Hsu
2012/0186019 A1 7/2012 Rawls-Meehan
2013/0000049 A1 1/2013 Hsu
2013/0069291 A1* 3/2013 Roma ..... A47C 27/063 267/170
2013/0089717 A1 4/2013 Loffelmann et al.
2013/0283530 A1 10/2013 Main et al.
2013/0340175 A1 12/2013 Stevens et al.
2014/0007656 A1 1/2014 Mahoney
2014/0059775 A1 3/2014 Khanzadian
2014/0114486 A1 4/2014 Ponnuhamy
2014/0137332 A1 5/2014 Mcguire et al.
2014/0137337 A1* 5/2014 DeFranks ..... A47C 27/06 5/722
2014/0182061 A1 7/2014 Zaiss et al.
2014/0250597 A1 9/2014 Chen et al.
2014/0257571 A1 9/2014 Chen et al.
2014/0259417 A1 9/2014 Nunn et al.
2014/0259418 A1 9/2014 Nunn et al.
2014/0259419 A1 9/2014 Stusynski et al.
2014/0259431 A1 9/2014 Fleury et al.
2014/0259433 A1 9/2014 Nunn et al.
2014/0259434 A1 9/2014 Nunn et al.
2014/0277611 A1 9/2014 Nunn et al.
2014/0277778 A1 9/2014 Nunn et al.
2014/0277822 A1 9/2014 Nunn et al.
2015/0007393 A1 1/2015 Palashewski
2015/0008710 A1 1/2015 Young et al.
2015/0025327 A1 1/2015 Young et al.
2015/0108188 A1 4/2015 Maclachlan et al.
2015/0182033 A1 7/2015 Brosnan et al.
2015/0182397 A1 7/2015 Palashewski et al.

(56) References Cited

U.S. PATENT DOCUMENTS

| | | | | |
|---|---|---|---|---|
| 2015/0182399 | A1 | 7/2015 | Rose et al. | |
| 2015/0182418 | A1 | 7/2015 | Zaiss | |
| 2015/0290059 | A1 | 10/2015 | Brosnan et al. | |
| 2015/0351982 | A1* | 12/2015 | Krenik | A47C 23/06 5/616 |
| 2016/0015184 | A1 | 1/2016 | Nunn et al. | |
| 2016/0058641 | A1 | 3/2016 | Moutafis et al. | |
| 2016/0073789 | A1* | 3/2016 | Hyltenfeldt | A47C 27/064 267/89 |
| 2016/0100696 | A1 | 4/2016 | Palashewski et al. | |
| 2016/0192886 | A1 | 7/2016 | Nunn et al. | |
| 2016/0242562 | A1 | 8/2016 | Karschnik et al. | |
| 2016/0367039 | A1 | 12/2016 | Young et al. | |
| 2017/0000685 | A1 | 1/2017 | Rohr et al. | |
| 2017/0003666 | A1 | 1/2017 | Nunn et al. | |
| 2017/0035212 | A1 | 2/2017 | Erko et al. | |
| 2017/0049243 | A1 | 2/2017 | Nunn et al. | |
| 2017/0065220 | A1 | 3/2017 | Young et al. | |
| 2017/0128297 | A1 | 5/2017 | Cernasov et al. | |
| 2017/0173262 | A1 | 6/2017 | Veltz | |
| 2017/0191516 | A1 | 7/2017 | Griffith et al. | |
| 2017/0208941 | A1 | 7/2017 | Trakic | |
| 2017/0224124 | A1 | 8/2017 | Blumberg | |
| 2017/0303697 | A1 | 10/2017 | Chen et al. | |
| 2017/0312155 | A1 | 11/2017 | Copetti | |
| 2017/0354268 | A1 | 12/2017 | Brosnan et al. | |
| 2017/0356815 | A1 | 12/2017 | Madden et al. | |
| 2018/0036198 | A1 | 2/2018 | Mergl et al. | |
| 2018/0161225 | A1 | 6/2018 | Zerhusen et al. | |
| 2018/0192781 | A1 | 7/2018 | Hyltenfeldt et al. | |
| 2018/0199726 | A1 | 7/2018 | Greenhalgh et al. | |
| 2018/0325274 | A1 | 11/2018 | Hager | |
| 2019/0133331 | A1 | 5/2019 | Kramer et al. | |
| 2020/0163817 | A1 | 5/2020 | Verkaaik et al. | |
| 2020/0187664 | A1 | 6/2020 | Duncan et al. | |
| 2020/0187665 | A1 | 6/2020 | Duncan et al. | |
| 2021/0307529 | A1 | 10/2021 | Kim et al. | |

FOREIGN PATENT DOCUMENTS

| | | | |
|---|---|---|---|
| CA | 1281820 | C | 3/1991 |
| CA | 77379 | S | 10/1995 |
| CN | 204306471 | U | 5/2015 |
| CN | 108354380 | A | 8/2018 |
| EP | 2893847 | A1 | 7/2015 |
| EP | 3034060 | A1 | 6/2016 |
| NL | 1035506 | C2 | 12/2009 |
| WO | 0002516 | A1 | 1/2000 |
| WO | 2007070397 | A2 | 6/2007 |
| WO | 2016138082 | A1 | 9/2016 |

OTHER PUBLICATIONS

Muscular Pystrophy Association, "One Good Turn", Published Aug. 31, 2006, https://www.mda.org/quest/article/one-good-turn, Retrieved from internet on Dec. 13, 2019, 10 pages.

Smart Mattress Company BV, "Smart Mattress", http://www.smartmattress.nl/?lang=en, Retrieved from internet on May 17, 2023, 1 page.

International Searching Authority, Search Report and Written Opinion for related PCT/US2019/066368, mailed on Apr. 2, 2020, 9 pages.

International Searching Authority, Search Report and Written Opinion for related PCT/US2019/066380, mailed on Feb. 19, 2020, 7 pages.

International Searching Authority, Search Report and Written Opinion for related PCT/US2019/066348, mailed on Feb. 21, 2020, 9 pages.

International Searching Authority, Search Report and Written Opinion for related PCT/US2019/066362, mailed on Feb. 20, 2020, 7 pages.

* cited by examiner

SPRING MODULES FOR AN ADJUSTABLE SLEEPING SYSTEM

CROSS-REFERENCE TO RELATED APPLICATIONS

This application claims the benefit of U.S. Provisional Application Ser. No. 63/357,929, filed Jul. 1, 2022, which is incorporated herein by reference in its entirety.

BACKGROUND

Getting a good night's sleep is important, not only from the perspective of day-to-day cognitive functions, but also from the perspective of long term health. Some studies suggest that lack of sleep, or lack of sufficiently restful sleep, has long term health consequences. The long term health consequences include increased risk of dementia and Alzheimer's disease. Some factors that adversely affect the ability to get a good night's sleep are physiological, such as snoring, central apnea, obstructive apnea, and restless leg syndrome. However, other factors are environmental, such as the compliance of the sleeping surface upon which sleep is attempted, and sleeping position (though some physiological factors are sleep position dependent).

Many mattresses and beds purport to increase the restfulness of sleep. For example, one attempt in recent years is based on mattresses made of combinations of closed- and open-cell foams that purport to reduce high force areas regardless of sleep position, and to reduce communication of movement to sleeping partners. Other attempts in recent years use air bladders to create individual pockets of support, usually in horizontal rows across the width of a mattress. The air bladder mattresses enable changing air pressure within the bladders, and thus changing the force carried by each bladder. Each system has its respective drawbacks.

Any system and/or method which increases user comfort and flexibility of control would provide a competitive advantage in the marketplace.

SUMMARY

In accordance with one aspect of the disclosure, a spring module for an adjustable sleeping system includes a spring rail that defines a length, a width, an upper surface, and a lower surface. The spring rail has a plurality of apertures extending between the upper surface and the lower surface along the length. A plurality of adjustable spring assemblies are spaced along the length of the spring rail. Each adjustable spring assembly includes a motor with a stator and a rotor. The motor is coupled to the spring rail in alignment with one of the plurality of apertures. A lead screw is coupled to the rotor and extends above the upper surface of the spring rail. A spring plate is coupled to the lead screw for translation along the lead screw away from the spring rail in response to rotation of the lead screw in a first direction and for translation along the lead screw toward the spring rail in response to rotation of the lead screw in a second direction opposite the first direction. A main spring has a first end coupled to the spring plate. The main spring extends away from the spring plate to a second end opposite the first end. A tubular sock covers the main spring. The main spring is configured to be compressed within the tubular sock in response to the spring plate translating along the lead screw away from the spring rail, and to be de-compressed within the tubular sock in response to the spring plate translating along the lead screw toward the spring rail.

In accordance with another aspect of the disclosure, a spring module for an adjustable sleeping system includes a spring rail that defines a length, a width, an upper surface, and a lower surface. The spring rail has a plurality of apertures extending between the upper surface and the lower surface along the length. A plurality of adjustable spring assemblies are spaced along the length of the spring rail. Each adjustable spring assembly includes a motor with a stator and a rotor. The motor is coupled to the spring rail in alignment with one of the plurality of apertures. A lead screw is coupled to the rotor and extends above the upper surface of the spring rail. A spring plate is coupled to the lead screw for translation along the lead screw away from the spring rail in response to rotation of the lead screw in a first direction and for translation along the lead screw toward the spring rail in response to rotation of the lead screw in a second direction opposite the first direction. A main spring has a first end coupled to the spring plate. The main spring extends away from the spring plate to a second end opposite the first end. A load cell is rigidly coupled to the stator and to the upper surface of the spring rail, wherein a force carried by the spring assembly is transferred to the spring rail through the load cell.

BRIEF DESCRIPTION OF THE DRAWINGS

For a detailed description of example embodiments, reference will now be made to the accompanying drawings in which.

DETAILED DESCRIPTION

Various terms are used to refer to particular system components. Different companies may refer to a component by different names—this document does not intend to distinguish between components that differ in name but not function. In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection or through an indirect connection via other devices and connections.

"Controller" shall mean, alone or in combination, individual circuit components, an application specific integrated circuit (ASIC), a microcontroller (with controlling software), and/or a processor (with controlling software), configured to read signals and take control actions responsive to such signals.

The following discussion is directed to various embodiments of the invention.

Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Various embodiments are directed to adjustable sleeping systems. More particular, example embodiments are directed to an adjustable sleeping system comprising a plurality of spring modules coupled to an underlying bed frame. Each spring module may comprise a plurality of adjustable spring assemblies, and the weight or force carried by each adjustable spring assembly may be changed to accomplish any of a variety of firmness settings or functions. Each adjustable spring assembly a load cell comprising rectangular machined piece of aluminum with four arms that connects to a spring rail. Each arm has a group of strain gauge connected to it that report back the amount of down force to a central computer. The specific design and benefit of this array of strain gauges transfers more consistent and reliable readings with less measurement drift. The unique attachment of the load cell to a motor increases stability and reliability in measurement of strain. This measurement is used to control motor position and help distribute pressure points in a bed. The design can be tuned to fit specific occupant loads by increasing or decreasing the thickness of the arms or the size of the overall design. This design is resistant to temperature differences and off axis loads. The specification first turns to a high level overview of the adjustable sleeping system in accordance with example embodiments.

Figure 1:
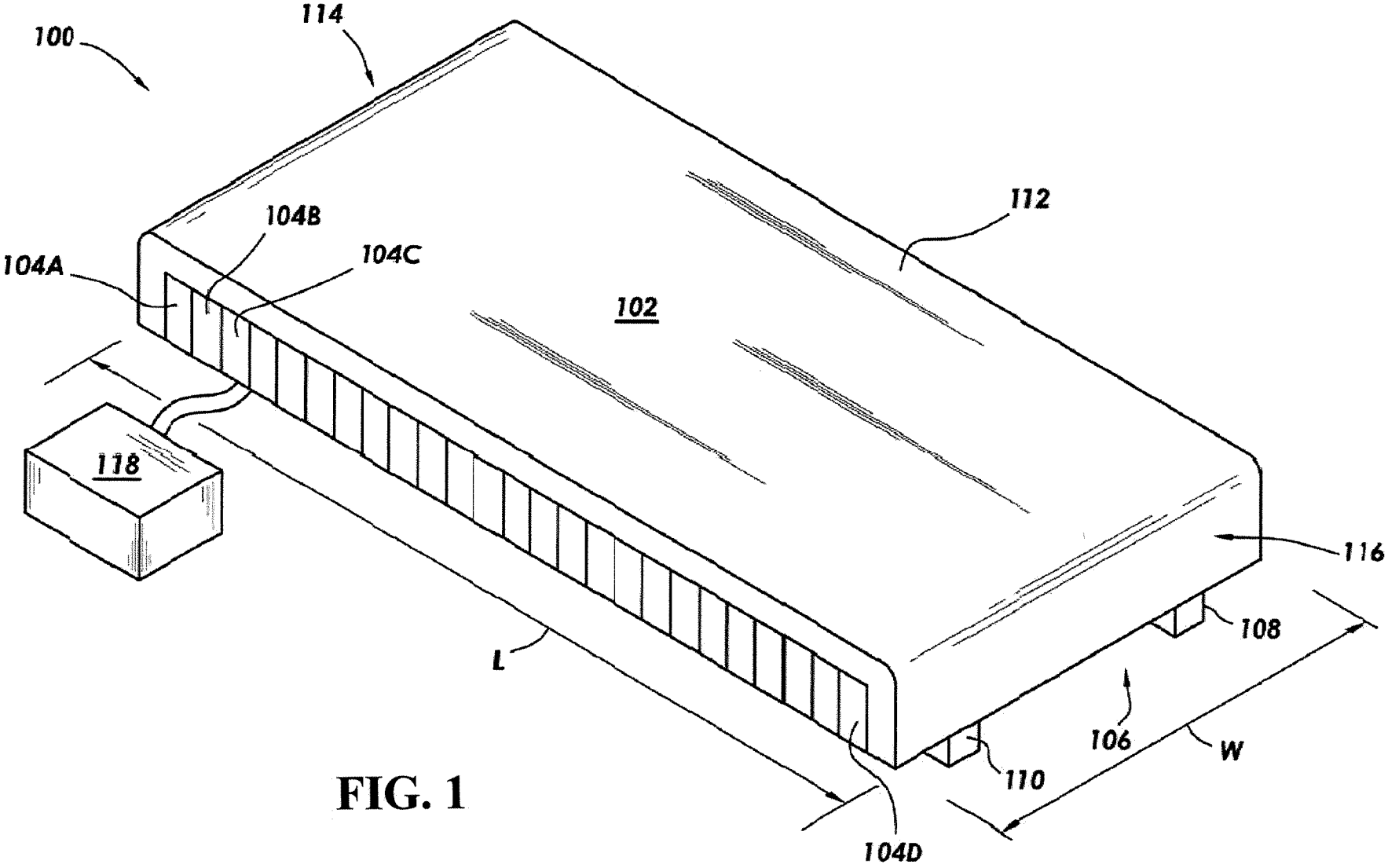
FIG. 1 shows a perspective view of an adjustable sleeping system in accordance with at least some embodiments.

FIG. 1 shows a perspective view of an adjustable sleeping system 100 in accordance with at least some embodiments. In particular, the example adjustable sleeping system 100 defines a length L, a width W, and a sleeping surface 102. The length L and width W may be any suitable size, such as a cot size, a single size, a twin size, a twin XL size, a full size, a Queen size, a "California" King, King size, or specialty sizes (e.g., for boats, motor homes, travel trailers). In some cases, the overall bed may comprise two adjustable sleeping systems 100 arranged side-by-side (e.g., two twin XL size beds side-by-side to form a King size). The adjustable sleeping system 100 further comprises a plurality of spring modules 104. In some cases, between 15 and 80 spring modules 104 may be used, in one example case between 20 and 30 spring modules 104 may be used, and in some cases 25 spring modules are used. FIG. 1 identifies with references numerals only four of the spring modules 104 (104A-104D) solely to not unduly complicate the figure. The spring modules are modular components that may be placed at any location, and thus a single spring module will be referred to as "spring module 104" and groups of spring modules will be referred to as "spring modules 104". The spring modules 104 are mechanically coupled to a bed frame 106 comprising a first frame rail 108 and a second frame rail 110, by way of example and without limitation.

In the example system, an upper surface of the spring modules 104 (the upper surface not visible in FIG. 1) is covered with a topper or overlay 112, such as open-cell or closed-cell foam overlay, by way of example and without limitation. In one example embodiment the overlay 112 comprises a foam padding having a thickness of three (3) inches (measured perpendicularly to the sleeping surface 102). Other thicknesses, both greater and smaller, and other constituent materials, may be used. In the example of FIG. 1, the overlay 112 wraps around the head end 114 of the adjustable sleeping system 100, and also wraps around the foot end 116 of the adjustable sleeping system 100. In other cases, the wrapping aspects of the overlay 112 may be omitted, and a spring module 104 on the head end 114 will be exposed on the head end 114, and another spring module 104 will be exposed on the foot end 116. In yet still other cases, the overlay 112 may be omitted entirely, and thus an upper surface defined by the spring modules 104 may define the sleeping surface 102.

Still referring to FIG. 1, the spring modules 104 can be considered to be arranged in a column extending along the length L, with each spring module 104 extending in a widthwise direction along the width W to define a row within the column. Each spring module 104 is coupled to the first frame rail 108 of the bed frame 106, and each spring module 104 is coupled to the second frame rail 110 of the bed frame 106.

The adjustable sleeping system 100 further comprises a bed controller 118 communicatively and controllably coupled to each spring module 104, and as discussed more below, communicatively and controllably coupled to the adjustable spring assemblies (not visible in FIG. 1) within each spring module 104. The bed controller 118 is configured to selectively control a load carried by each spring module 104, and more particularly to selectively control a load carried by each adjustable spring assembly within each spring module 104. The bed controller 118 may take any suitable form, such as a computer system, individual circuit components, an application specific integrated circuit (ASIC), a microcontroller (with controlling software), a processor (with controlling software), or combinations thereof configured to read signals and take control actions responsive to such signals.

Figure 2A:
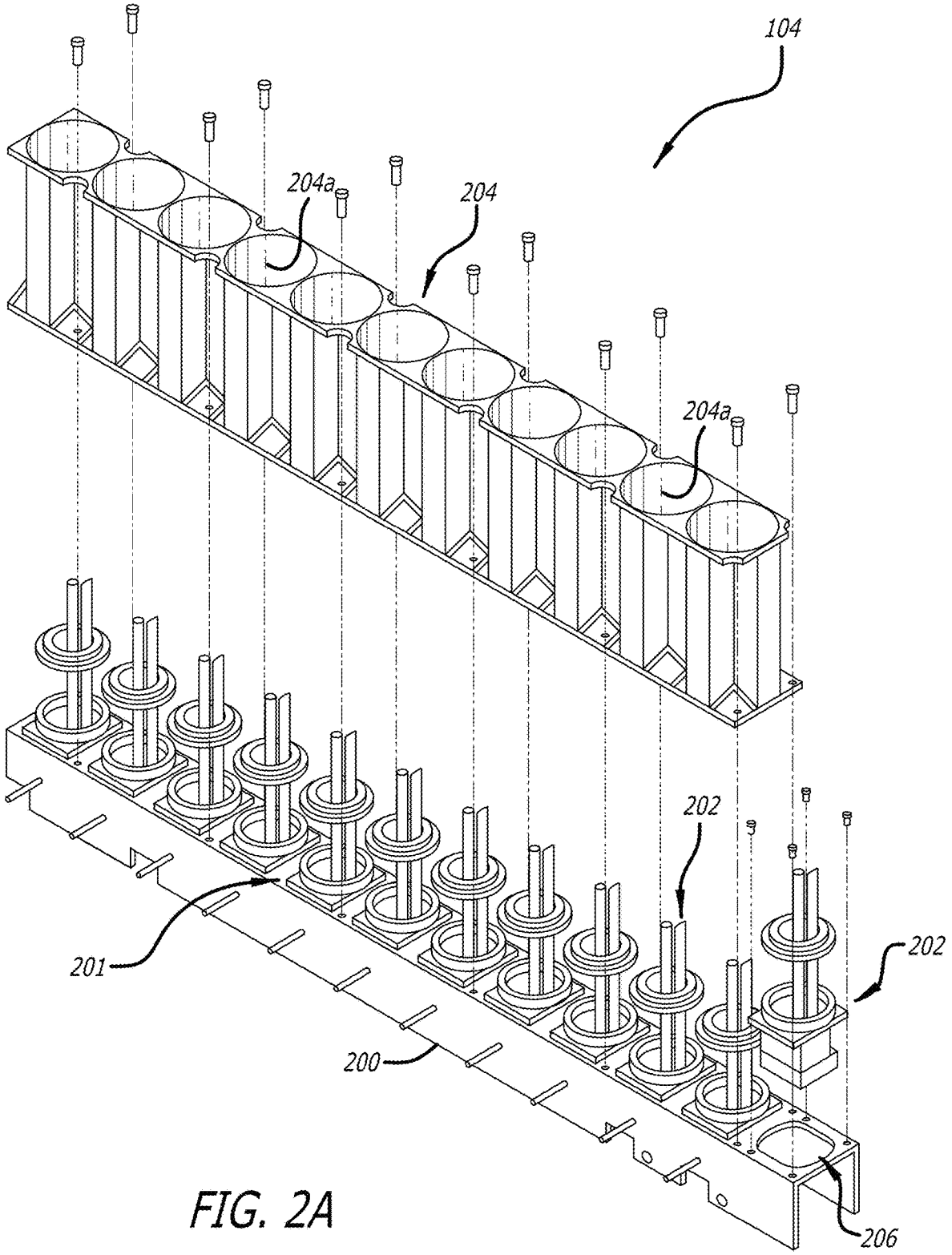
FIG. 2A shows an exploded perspective view of a spring module in accordance with at least some embodiments.

FIG. 2A shows an exploded perspective view of a spring module 104 in accordance with at least some embodiments. In particular, visible in FIG. 2A is a spring rail 200, as well as a plurality of adjustable spring assemblies 202. In some cases, between 8 and 40 adjustable spring assemblies 202 are used within each spring module 104, in one example case between 10 and 15 adjustable spring assemblies 202, and in a particular case 13 adjustable spring assemblies 202 are used. FIG. 2A labels two of the adjustable spring assemblies 202 so as not to unduly complicate the figure. The adjustable spring assemblies 202 are modular components that may be placed at any location within a spring module 104, and thus a single adjustable spring assembly will be referred to as "adjustable spring assembly 202" and groups of adjustable spring assemblies will be referred to as "adjustable spring assemblies 202". A rigid manifold, also referred to as divider 204, has a plurality of chambers, also referred to as cylinders 204*a* (only two labeled in FIG. 2A to avoid cluttering the figure), with each cylinder 204*a* receiving at least a portion of a separate one of the adjustable spring assemblies 202 therein. The divider 204 telescopes over the adjustable spring assemblies 202 into fixed relation with the spring rail 200, and may provide a location into which and out of which a telescoping member moves during use. Moreover, the divider 204 has a height taller (greater) than a height of the lead screw (discussed more below) of each adjustable spring assembly 202, and thus, such that the distal end of the lead screw is recessed below an upper surface of the divider 204, which prevents contact with the distal end of the lead screw by a user during use.

The example spring rail 200 defines a plurality of apertures 206 into which the adjustable spring assemblies 202 are coupled, though only one aperture 206 is visible in FIG. 2A. The number of apertures may correspond directly to the number of adjustable spring assemblies 202, and thus in some cases between 8 and 40 apertures are present within each spring module 104. In example embodiments, the spring rail 200 is made of metallic material, but any suitable material (e.g., high strength plastic, fiber glass) may be used.

Additional exterior components would be present in the spring module 104. For example, a fabric cover defining an upper surface would be present. Moreover, each adjustable spring assembly 202 additionally comprises a main spring, also referred to as spring 205 resting on the spring perch and the divider 204 that telescopes in assembly over the spring 205 and into respective aperture or cylinder of the divider 204. Such additional components are not show so as not to unduly complicate the figure. The discussion now turns to the adjustable spring assemblies 202.

Figure 2B:
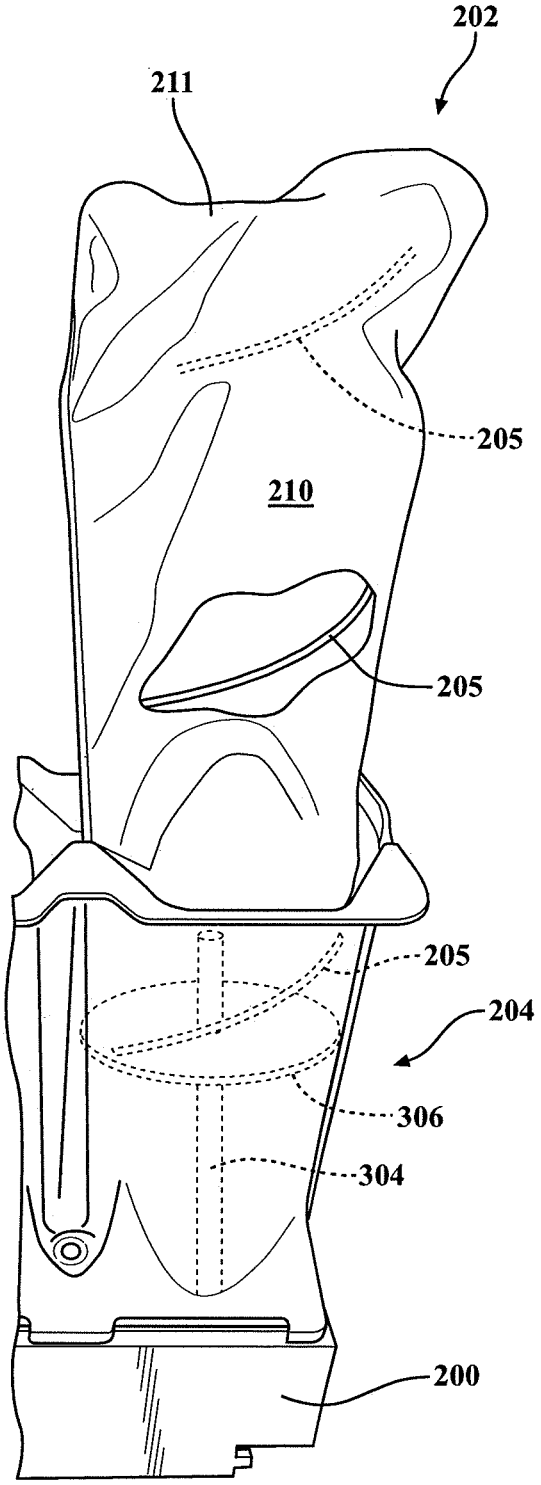
FIG. 2B shows an example of the divider with a sock disposed into a cylinder thereof, with the divider and sock telescoped over an adjustable spring assembly, with the spring shown in solid in a broken away portion of the sock and in hidden elsewhere, in accordance with at least some embodiments.

FIG. 2B shows an example fragmentary view of the divider 204 telescoped over an adjustable spring assembly 202, with a lower or proximal end of the divider 204 shown in fixed relation with the spring rail 200. In particular, each adjustable spring assembly 202 comprises a flexible fabric tube, also referred to as sock 210, having a closed end 211, with the sock 210 telescoped over the main spring 205 (partially visible through a broken away region of the sock 210), with the tubular sock 210 disposed into and lining an inner surface of the cylinder 204*a*. An open end of the sock 210 is coupled to a motor via a sock ring (discussed more below) in such a way that the preloading of the main spring 205 between the closed end 211 and a spring plate (discussed below) does not change the amount of force measured by a load cell (also discussed more below) associated with the adjustable spring assembly. That is to say, the main spring 205 can be preloaded for presenting anything from extra-plush to extra-firm without changing the amount of force measured by the load cell associated with the adjustable spring assembly.

Figure 3:
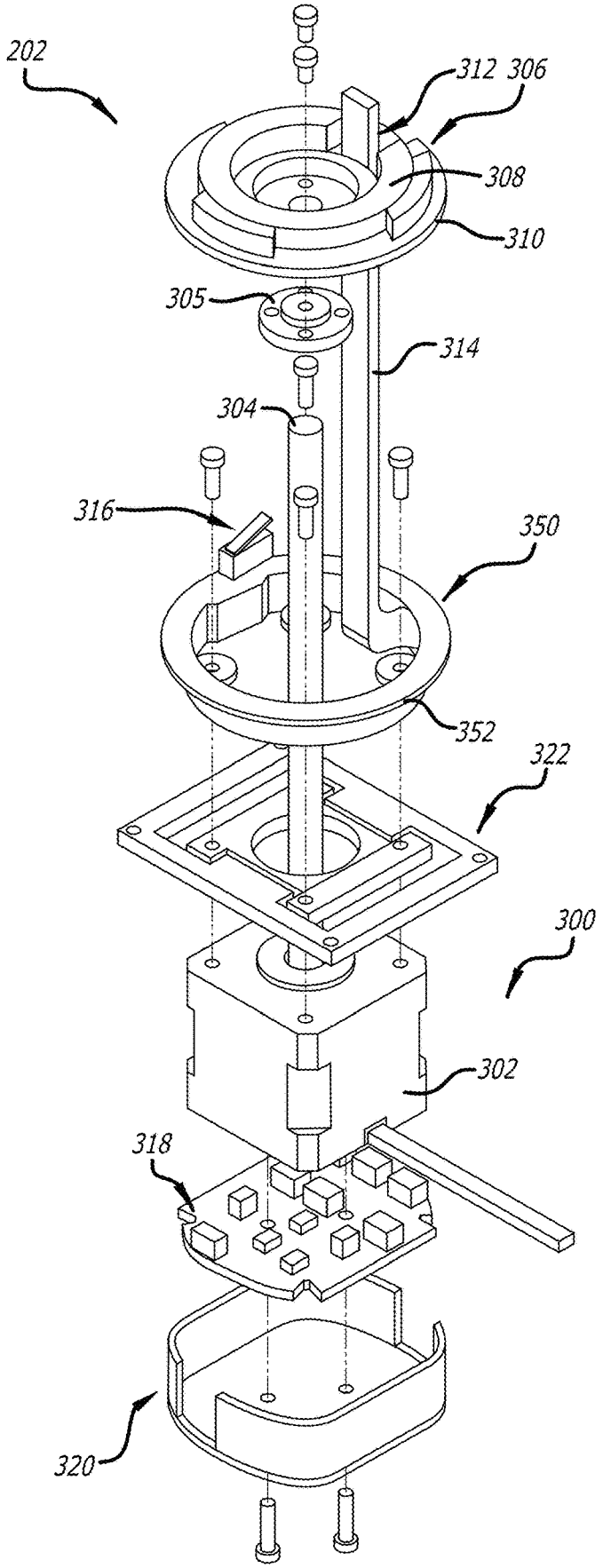
FIG. 3 shows an exploded perspective view of an adjustable spring assembly in accordance with at least some embodiments.

FIG. 3 shows an exploded perspective view of one adjustable spring assembly 202 in accordance with at least some embodiments. The example adjustable spring assembly 202 comprises a motor 300 with a stator 302 and a rotor 303. The rotor of the motor 300 is coupled to a proximal end of a lead screw 304. The motor 300 may comprise any suitable electric motor that can turn the lead screw 304, such as a stepper motor, a direct current (DC) motor, or an alternating current (AC) motor (e.g., squirrel cage or synchronous). Regardless of the type of motor 300, the motor 300 is controlled by the bed controller 118 (FIG. 1). In one example, the motor 300 is housed in a National Electrical Manufacturers Association (NEMA) 17 body, but other body types are also contemplated. Examples of how to couple the stator 302 to the spring rail 200 are discussed in greater detail below.

In the example adjustable spring assembly 202, the proximal end of the lead screw 304 is rigidly coupled to the rotor. Thus, as the rotor of the motor 300 turns, so too does the lead screw 304, but the lead screw 304 does not translate along its longitudinal axis; rather, the orientation and positon of the lead screw 304 relative an upper surface of the bed remains the same (and below an upper surface of the divider 204 (FIG. 2A)). Thus, the lead screw 304 in the example embodiments is referred to as a captive lead screw. However, in other embodiments the lead screw may be implemented as a non-captive lead screw, where turning of the rotor translates the lead screw along the longitudinal axis of the lead screw.

When assembled, the lead screw 304 extends above an upper surface (facing away from the motor 300) of the spring rail 200. A spring perch or spring plate 306 is coupled to the lead screw 304 such that as the lead screw 304 is turned by the motor 300, the spring plate 306 translates up (when the lead screw rotates in a first direction) and down (when the lead screw rotates in a second direction opposite the first direction) along the longitudinal axis of the lead screw 304. In embodiments where the lead screw 304 is a captive lead screw, the axial relationship of the lead screw 394 to the motor 300 does not change, and the spring plate 306 is threadingly coupled to the lead screw 304 such that as the lead screw 304 turns, the axial location of the spring plate 306 along the lead screw 304 changes. The spring plate 306 can be threadingly coupled to the lead screw 304 via a threaded nut 305, wherein the threaded nut 305 is fixed as a subcomponent to spring plate 306 for conjoint movement therewith along the lead screw 304 when the lead screw 304 is rotated by the motor 300.

Figure 2C:
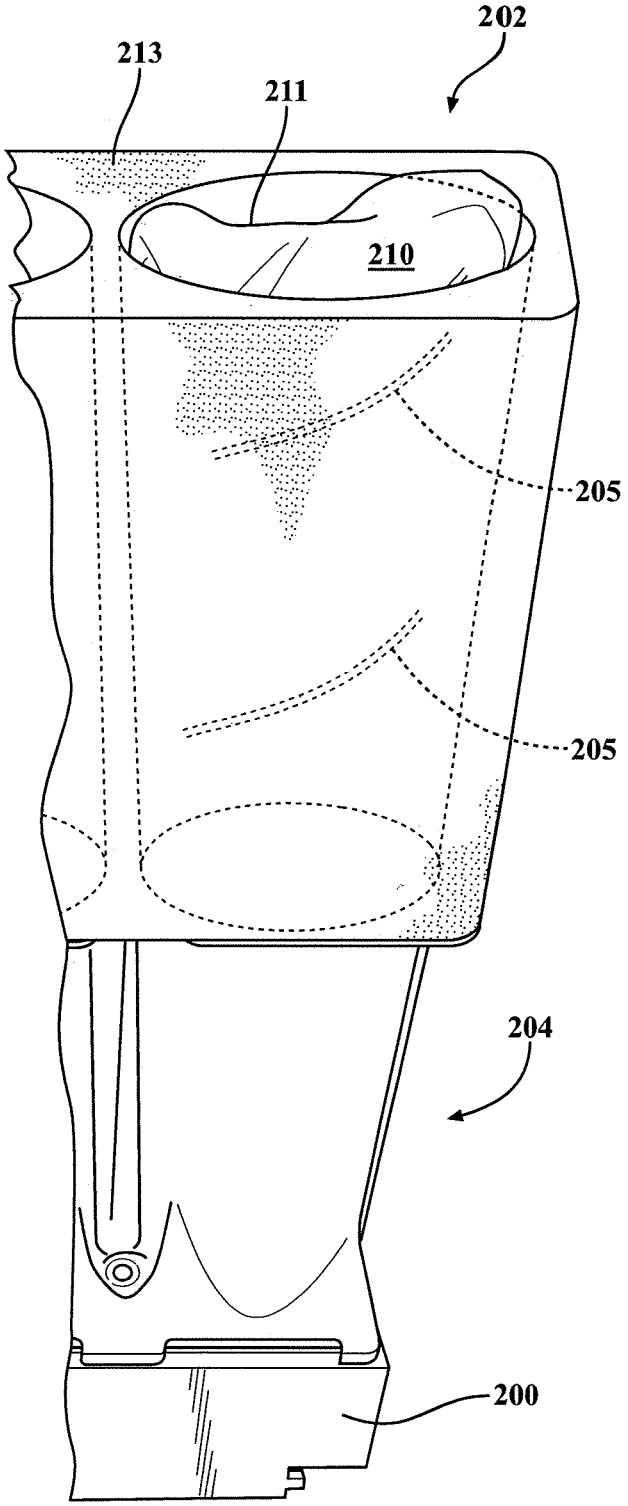
FIG. 2C is similar to FIG. 2B, showing a compliant insert disposed between adjacent main springs of the adjustable spring assemblies to maintain the main springs in an upright, vertical orientation during use.

The adjustable spring assembly 202 further includes main spring 205. When assembled, a first end, also referred to as proximal end, of the main spring 205 couples to the spring plate 306, and the second end, also referred to as distal end, abuts an inside surface of the closed end 211 of the sock 210, which extends upwardly and outwardly from the cylinder 204*a* of the divider 204, such as shown in FIG. 2B, to support a load. In example embodiments, the main spring 205 is a helical spring that may be barreled or straight. In some cases, the main spring 205 has a constant spring factor K along its length. In other cases, however, the main spring 205 may have two or more spring constants along its length. As further shown in FIG. 2C, a compliant insert or multiple inserts 213 can be disposed to occupy space between adjacent main springs 205 to counteract side loads and reduce side loading imparted on the main springs 205 and on the spring assemblies 202 in general, thereby maintaining the adjacent main springs 205 in a substantially upright orientation relative to the spring rail 200. The compliant insert 213 is formed of a lightweight compliant material, such as an open cell foam, by way of example and without limitation, thereby acting to maintain the main springs 205 in their vertical orientation relative to the spring rail 200, however, the compliant insert 213 is not intended to support significant vertical load. Rather, the vertical load is supported by main springs 205 while being maintained in their vertical orientation, at least in part, by the compliant insert 213. In the non-limiting embodiment illustrated, the compliant insert 213 is formed as a monolithic, single piece of material, having through bores sized for telescoped receipt over the main springs 205. Accordingly, the single piece compliant insert 213 has a shaped of a cylinder head, though high compliant along the axial direction of the lead screw 304.

Regardless of the exterior shape and/or how many spring constants the main spring 205 may implement, in example embodiments the spring 205 has a free height, also referred to as un-laden (unloaded) height, between and including 5 inches to 20 inches, in some cases between 8 inches to 15 inches, and in a particular case about 11 inches. When the spring module 104 is fully assembled, each main spring 205 is compressed or preloaded, making the pre-load height between and including 4 inches to 19 inches, in some cases between and including 7 inches to 14 inches, and in a particular case about 10 inches.

As the name implies, each adjustable spring assembly 202 is designed and constructed such that the force carried by each main spring 205 can be adjusted. When the bed controller 118 (FIG. 1) determines a particular adjustable spring assembly 202 should carry more force, the motor 300 is activated to move the spring plate 306 away from the spring rail 200 and toward the sleeping surface 102 (FIG. 1). When supporting a load, moving the spring plate 306 away from the spring rail 200 compresses the main spring 205, and thus, the main spring 205 supports an increased weight or force. Oppositely, when the bed controller 118 determines a particular adjustable spring assembly 202 should carry less force, the motor 300 is activated to move the spring plate 306 toward the spring rail 200 and away from the sleeping surface 102. When supporting a load, moving the spring plate 306 toward the spring rail 200 thus de-compresses the main spring 205, and thus, the main spring 205 carries less weight or less force.

Still referring to FIG. 3, again, the spring plate 306 is coupled to the lead screw 304 as discussed above, with the precise type of coupling dependent upon how the lead screw 222 is coupled to the rotor of the motor 300 (e.g., captive and non-captive lead screw). The example spring plate 306 defines an annular shoulder 308 that circumscribes the location of the lead screw 304, and a stop, such as annular flange 310, that extends outward, shown as extending outward from below the annular shoulder 308, by way of example and without limitation. The lower end of the main spring 205 is coupled to the spring plate 306 by telescoping over the annular shoulder 308 and resting on the annular flange 310. The example spring plate 306 further defines an anti-rotation aperture 312 through the spring plate 306 and disposed between the location of the coupling to the lead screw 304 and the annular flange 310. As the name implies, when present the anti-rotation aperture 312 works in conjunction with a post 314, shown as extending upwardly from a sock ring 350 (discussed below) to hold the spring plate 306 against rotation during periods of time when the motor 300 is turning the lead screw 304. In the example of FIG. 3, the lower side of the stator 302 is associated with a control PCB 318, and cover piece 320.

The example adjustable spring assembly 202 further comprises a zero-position micro-switch 316. In example embodiments, the zero-position micro-switch 316 informs the motor controller when the spring plate 306 has reached is lowest or zero position (which may also be a position where the respective main spring 205 carries the least force).

The example micro-switch 316 sits atop an example sock ring 350. The sock ring 350 defines an annular lip or channel 352. The open end of the sock 210 telescopes over the main spring 205 and is rigidly coupled to the motor 300 via the sock ring 350 at the annular channel 352. Any fixation mechanism can be used to fix the open end to the annular channel 352, including clip ring, adhesive, weld, or otherwise. The tubular sock 210 has a length extending from the closed end 211 to the open end, the length remaining substantially the same when the main spring 205 is compressed and de-compressed within the tubular sock 210 in response to the spring plate 306 translating along the lead screw 304. Considering FIGS. 2A and 3 simultaneously, if the adjustable spring assembly 202 is not carrying a load (e.g., the material of the sock 210 is taught under on the applied force by the main spring 205, movement of the spring plate 306 in either direction does not change the amount of weight or force carried by the adjustable spring assembly 202. Given the assumptions, the preloaded height of the main spring 205 changes, and the tension in the sock 210 changes, but such does not result changes in weight or force carried by the adjustable spring assembly 202. The tension in the sock 210 increases as the main spring 205 is compressed within the sock 210 and decreases as the main spring 205 is de-compressed within the sock 210. Further, the tension within the sock 210 holds the spring plate 306 against rotation when the lead screw 304 is rotating.

In various examples, each adjustable spring assembly 202 is suspended within its respective aperture 206 (FIG. 2A) of the spring rail 200 by way of load cell 322. In particular, the example load cell 322 is rigidly coupled to the stator 302 of motor 2300, and when installed in an aperture 206 of the spring rail 200, is rigidly coupled to the spring rail 200. The load cell 322 is sandwiched between the annular sock ring 350 and the stator 302, wherein the load cell 322 is rigidly coupled to the motor 300 and to an upper surface 201 of the spring rail 200 to suspend the motor 300 in alignment with one of the apertures 206. The motor 300 is supported entirely by the load cell 322. It follows that the amount weight or force carried by any particular adjustable spring assembly 202 is transferred to the spring rail 200 through the load cell 322. In example cases then, the amount of weight or force carried by any particular adjustable spring assembly 202 may be measured by the load cell 322.

Figure 4B:
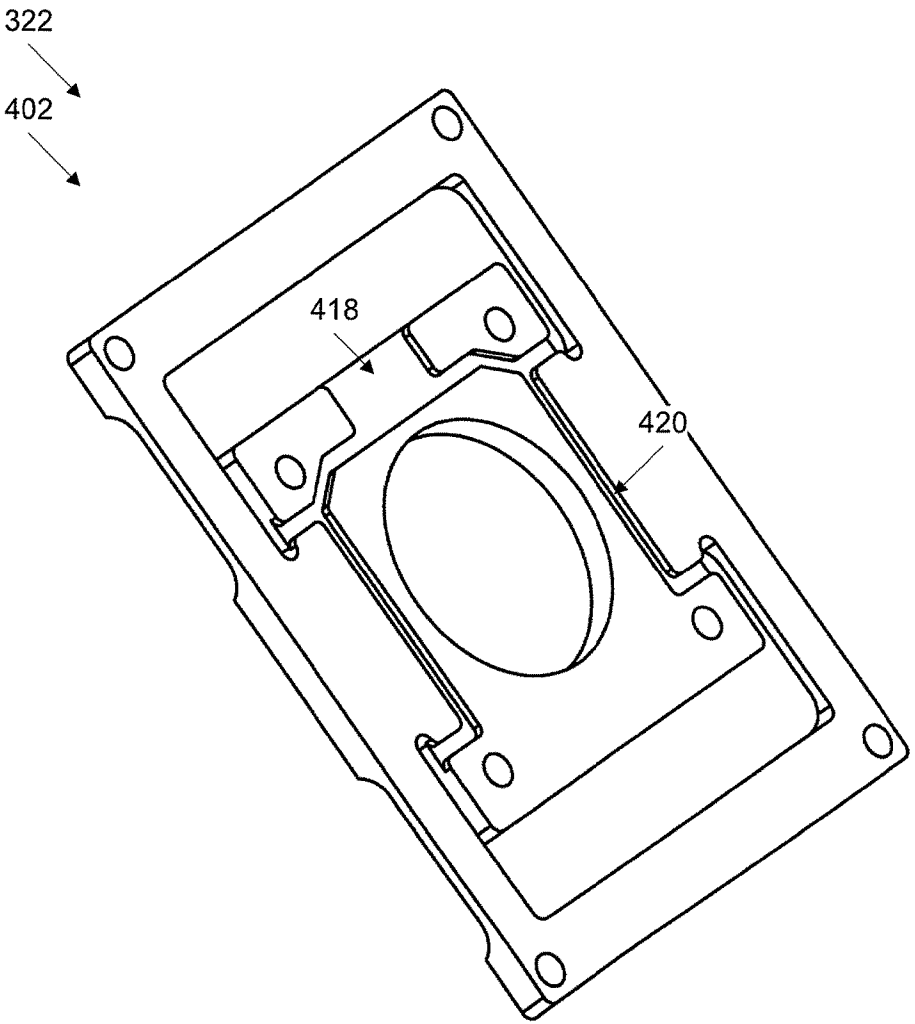
FIG. 4B shows a top perspective view of the load cell of FIG. 4A.
Figure 4A:
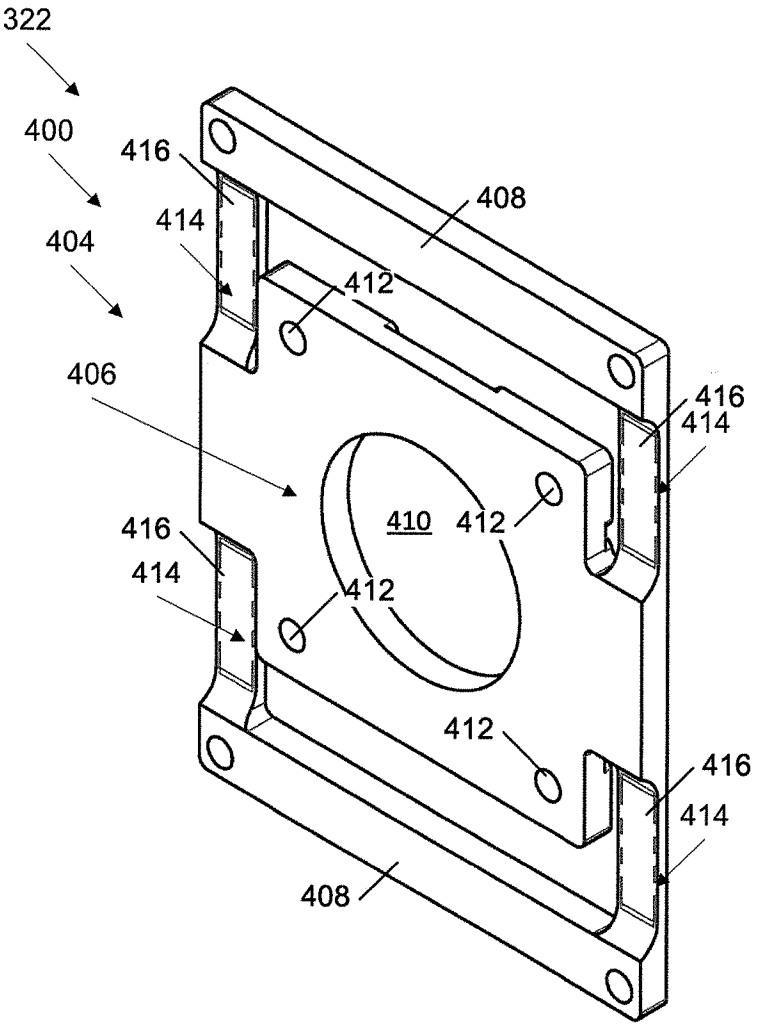
FIG. 4A shows a bottom perspective view of a load cell in accordance with at least some embodiments.

FIG. 4A shows a bottom perspective view 400 and FIG. 4B shows a top perspective view 402 of a load cell 322 in accordance with at least some embodiments.

In various examples, the load cell 322 comprises a frame 404. In many cases the frame 404 is a metallic material (e.g., aluminum), but depending upon the amount weight or force carried other suitable materials may be used (e.g., high density plastics). The example frame 404 defines a stator connector 406 and two frame connectors 408, wherein the frame connectors 408 extend in generally parallel relation with one another along opposite sides of the stator connector 406. The example stator connector 406 defines a lead-screw aperture 410 as well as a plurality of fastener apertures 412. The stator connector 406 is configured for directed attachment to the motor 300, and in a non-limiting embodiment, to the stator 302, and the frame connectors 408 are configured for direct attachment to the upper surface 201 of the spring rail 200. By being attached to the upper surface 201, the load cell 322 and frame connectors 408 thereof can be increased in size and width relative to a load cell being attached beneath the upper surface 201, as the load cell 322 and frame connectors 408 are not confined by interior side walls of the spring rail 200. Accordingly, a larger load cell can be used, and the fixation to the spring rail 200 can be made more secure, thereby increasing the accuracy and reliability of the load cell 322. When assembled with the stator 302 (FIG. 3), the rotor and/or lead screw 304 (FIG. 3) telescope through the lead-screw aperture 410, the stator connector 406 abuts an upper surface of the stator 302, and the stator 302 is held in the abutting relationship by fasteners (not shown) telescoped through the fastener apertures 412. Accordingly, the upper surface of the stator 302 is fixed to a bottom surface of the stator connector 406.

The example load cell 322 further defines a plurality of connecting arms 414 that extend between the stator connector 406 and the frame connectors 408. In the example of FIGS. 4A and 4B, four such connecting arms 414 are shown, but two or more connecting arms may be used, depending upon the amount of weight or force to be carried by the connecting arms 414. Each connecting arm 414 is rigidly coupled on a first end to the stator connector 406 and rigidly coupled on a second end to a frame connector 408, thereby operably connecting the stator connector 406 to the frame connector 408.

In some cases, and as shown, the connecting arms 414 are integral or integrally formed as a monolithic piece of material with the stator connector 406 and the frame connectors 408. For example, the entire load cell 322 may be cast as a single component, or machined, such as milled, from a single ingot of metallic material. In other cases, however, the connecting arms 414 may be separate components fixedly assembled with the stator connector 406 and the frame connectors 408, such as via weld joints and/or other fixation mechanism(s).

When the load cell 322 is assembled into an adjustable spring assembly 202 of FIG. 2A, and when the adjustable spring assembly 202 is coupled to a spring rail 200 via the load cell 322 and forms a part of spring module 104, as the adjustable spring assembly 202 carries more weight or force, the connecting arms 414, which operably couple the spring assembly 202 to the spring rail 200, bend or flex slightly, such that the motor 300 (FIG. 3) moves slightly downward in conjoint relation with the stator connector 406 in relation to gravity. Oppositely, as the adjustable spring assembly 202 carries less weight or force, the connecting arms 414 bend or flex the opposite direction slightly, such that the motor 300 (FIG. 3) and stator connector 406 move conjointly slightly upward in relation to gravity. As such, a force carried by the adjustable spring assembly 202 is transferred to the spring rail 200 through the load cell 322. The amount of movement may be minute, and may not even be recognizable by the naked eye, but is nevertheless present, thereby sending a signal to bed controller 118.

Still referring to FIG. 4A, in example systems the load cell 322, in combination with external electronic devices, measures the amount of deflection in the connecting arms 414 using strain gauges. In particular, each connecting arm 414 defines strain surface 416. During construction of the load cell 322 and under no-load conditions, each strain surface 416 is created a flat surface (within manufacturing tolerances). Further, each strain surface 416 is associated with a strain sensor, such as a set of resistive elements arranged as a Wheatstone Bridge Sensor, though any suitable type of strain sensor may be used (e.g., strain sensors based on path length of optical fibers). Thus, by reading the strain associated with each connecting arm 414, the amount of weight or force carried by the load cell 322 may be determined. In one example, each strain gauge may be a part number CA350-2 GB(23)C18-105 strain gauge available from Hunan Detail Sensing Technology Company of Changsha City, Hunan Province, China.

Still referring to FIG. 4B, the top perspective view 402 shows a plurality of pockets or channels, also referred to as trenches, such as trenches 418 and 420. After strain sensors are coupled to their respective strain surfaces 416, the electrical wires may traverse along and within the trenches 418, 420 defined on the top surface, such as to protect the wires. In some cases, the wires may be encapsulated within the trenches 418, 420, such as by a resin, an epoxy or polymeric material (e.g., rubber-like material).

Relatedly, the strain sensors may also be encapsulated in place, such as by an epoxy or polymeric material.

Figure 5A:
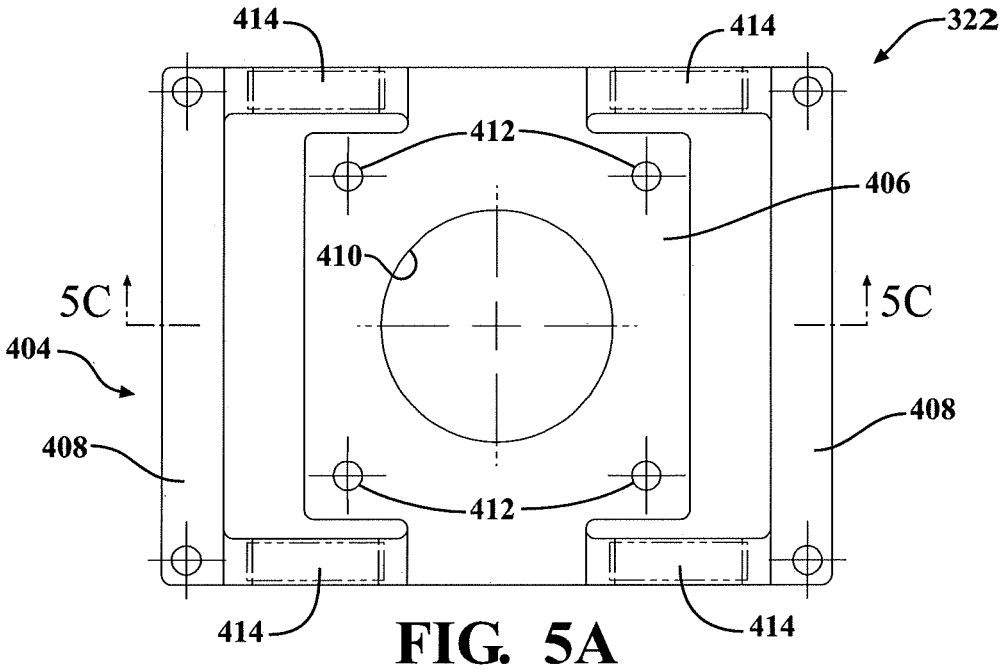
FIG. 5A shows a bottom elevation view of the example load cell in accordance with at least some embodiments.
Figure 5B:
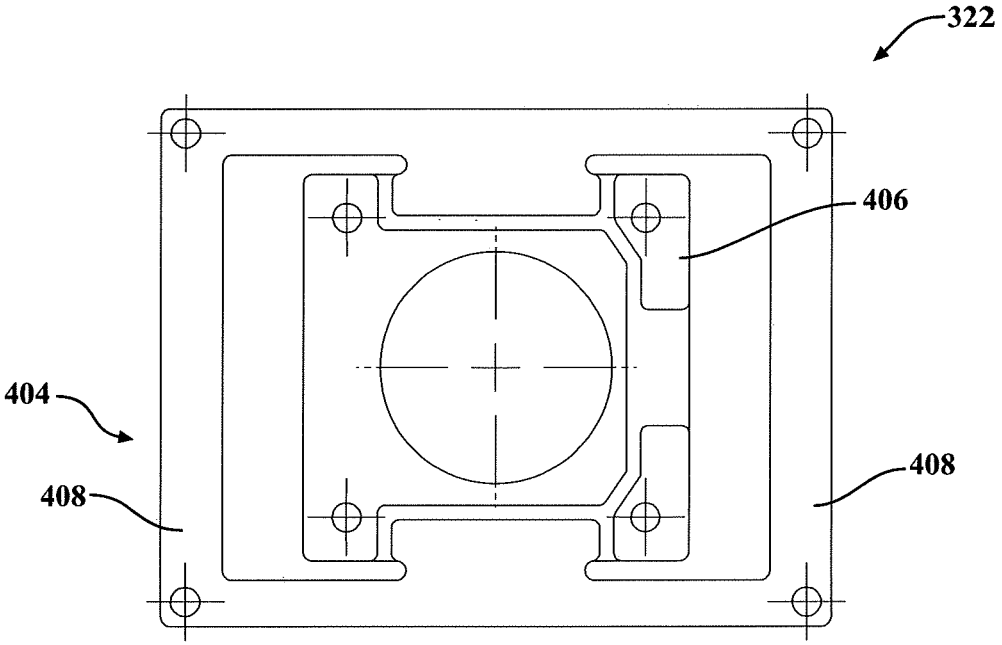
FIG. 5B shows a top elevation view of the example load cell of FIG. 5A.
Figure 5C:
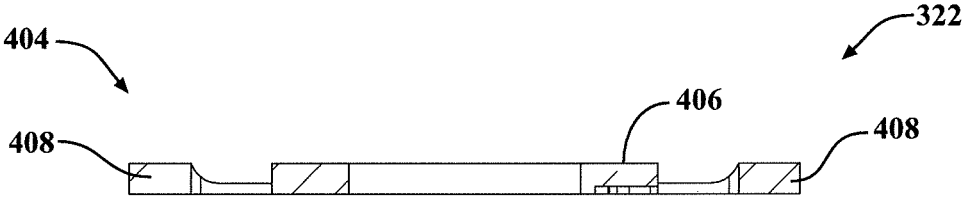
FIG. 5C shows a cross-sectional view taken generally along the line 5C-5C of FIG. 5A.

FIGS. 5A and 5B show a bottom and top elevation views, respectively, of the example load cell 322 in accordance with at least some embodiments. FIG. 5C shows a cross-sectional view taken generally along the line 5C-5C of FIG. 5A. The example load cell 322 has a width of about 54 millimeters (mm) and a length of about 70 mm. In various examples, the amount of weight or force carried by an adjustable spring assembly 202 may be less than 10 pounds, and many cases is designed for best accuracy below 5 pounds. In some cases the load cell 322 of an adjustable spring assembly 202 may be accurate and repeatable to within +/−0.05 pounds in a predetermined range (e.g., zero to three pounds). The relationship between the supported area of the load cell (e.g., 70 mm×54 mm or about 38 square centimeters ($cm^2$) to the amount of force carried is high (e.g., about 0.07 pounds/$cm^2$) compared to related art devices. However, the arrangement of the load cell provides better lateral support for the adjustable spring assembly 202.

Figure 6A:
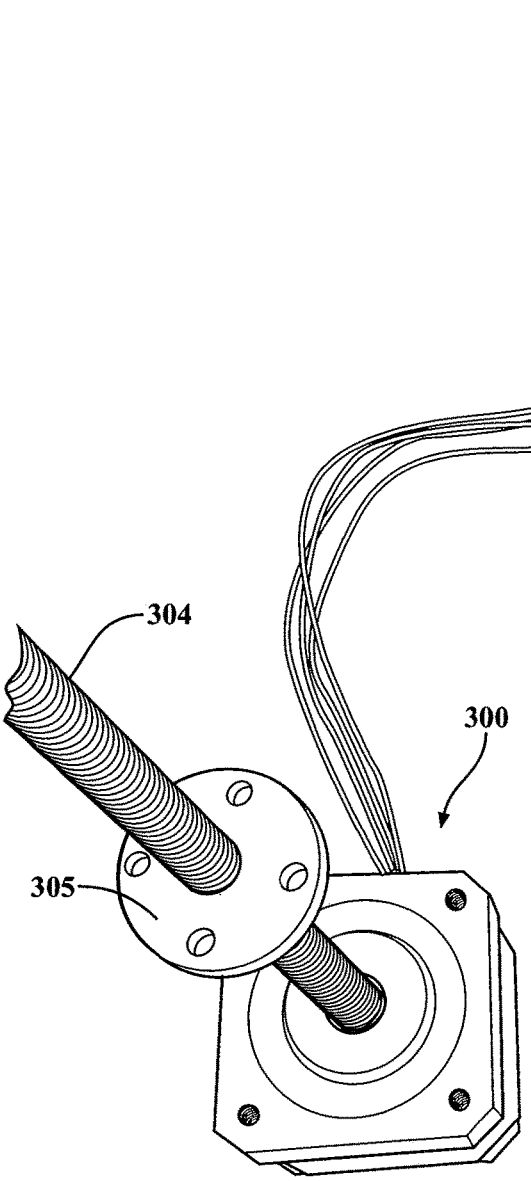
FIG. 6A shows an overhead perspective view of a motor and lead screw of a spring assembly in accordance with at least some embodiments.
Figure 6B:
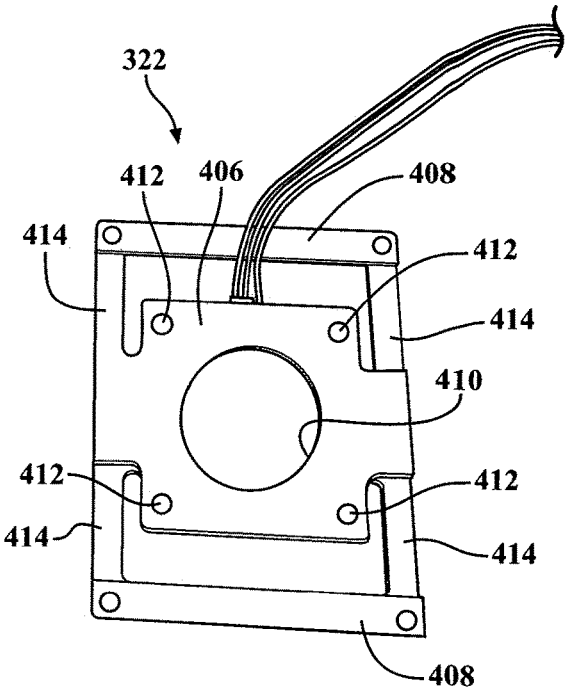
FIG. 6B shows an overhead perspective view of a bottom of an example load cell in accordance with at least some embodiments.

FIG. 6A shows an overhead perspective view of a motor 300, lead screw 304, and nut 305. FIG. 6B shows an overhead bottom perspective view of the example load cell 322. FIG. 6B best illustrates how the strain sensors are encapsulated, and thus not visible.

Figure 7:
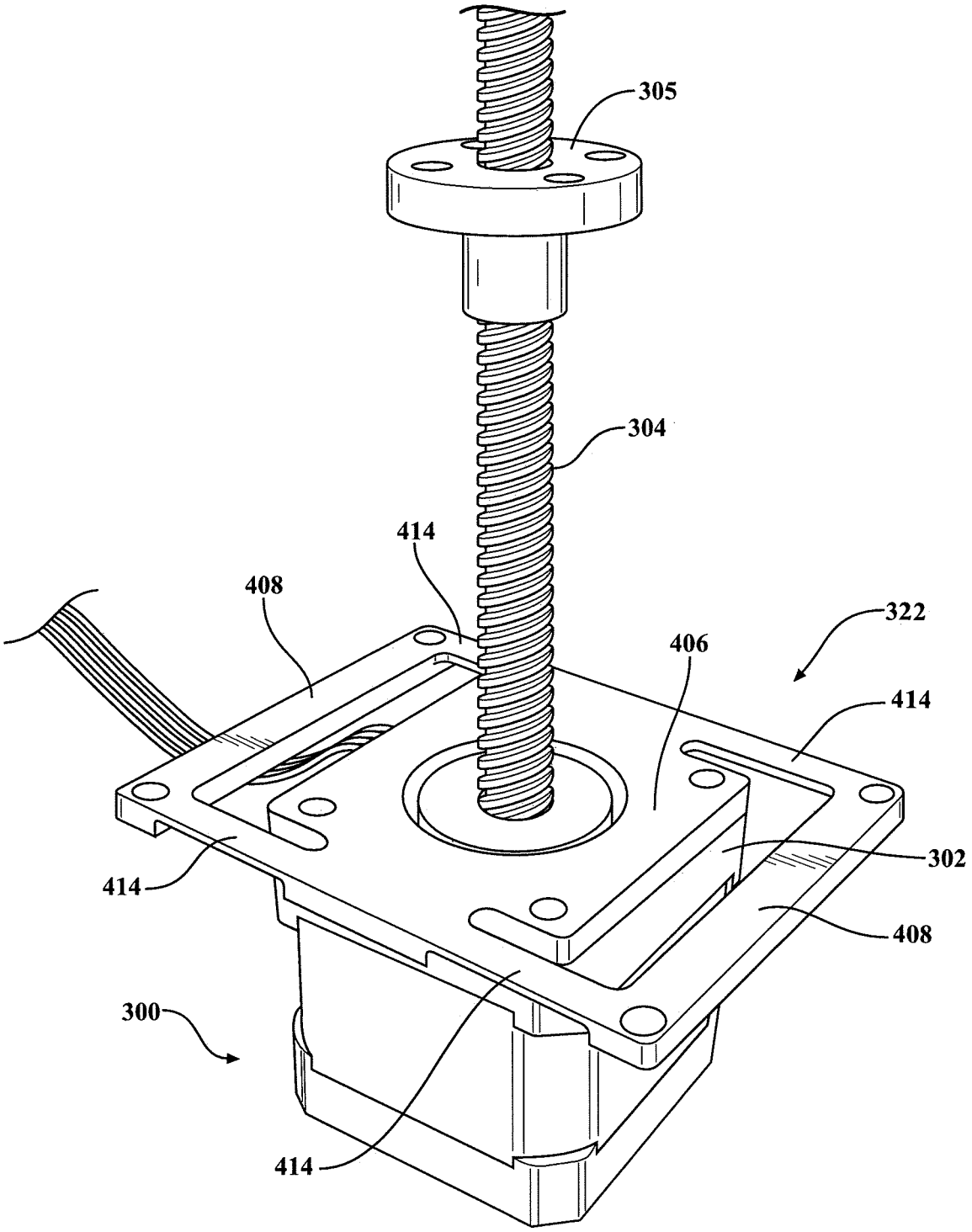
FIG. 7 shows a side perspective view of a motor and lead screw of a spring assembly, with a load cell abutting an upper surface of a stator of the motor in accordance with at least some embodiments.

FIG. 7 shows a side perspective view of a motor 300, lead screw 304 and nut 305, with a load cell 322 resting on the upper surface of the stator 302. Notice how the electrical leads within the trenches are encapsulated, such as for protection from abrasion or disconnection.

Figure 8:
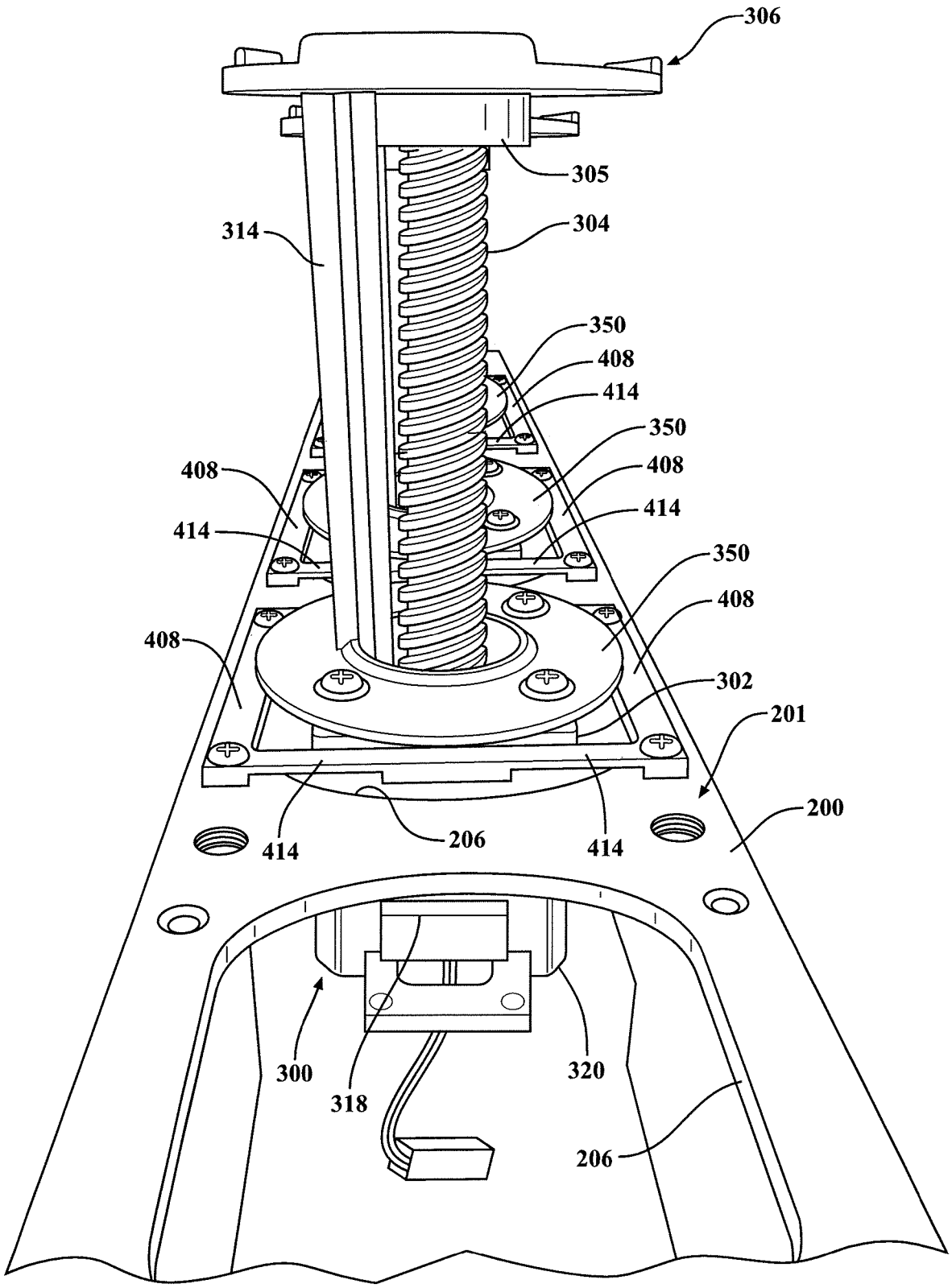
FIG. 8 shows a fragmentary perspective view of an adjustable spring assembly suspended through an aperture of a spring rail by way of an example load cell supported on an upper surface of a spring rail of the adjustable spring assembly accordance with at least some embodiments.

FIG. 8 shows a partially assembled perspective view of an adjustable spring assembly 202 suspended through an aperture 206 of a spring rail 200 by way of an example load cell 322.

The above discussion is meant to be illustrative of the principles and various embodiments of the present invention. Numerous variations and modifications will become apparent to those skilled in the art once the above disclosure is fully appreciated. It is intended that the following claims be interpreted to embrace all such variations and modifications.

What is claimed is:

1. A spring module for an adjustable sleeping system, comprising:

a spring rail that defines a length, a width, an upper surface, and a lower surface, the spring rail having a plurality of apertures extending between the upper surface and the lower surface along the length; and a plurality of adjustable spring assemblies spaced along the length of the spring rail;

each adjustable spring assembly comprises:

a motor with a stator and a rotor, the motor coupled to the spring rail in alignment with one of the plurality of apertures;

a lead screw coupled to the rotor and extending above the upper surface;

a spring plate coupled to the lead screw for translation along the lead screw away from the spring rail in response to rotation of the lead screw in a first direction and for translation along the lead screw toward the spring rail in response to rotation of the lead screw in a second direction opposite the first direction;

a main spring having a first end coupled to the spring plate, the main spring extending away from the spring plate to a second end opposite the first end;

a tubular sock covering the main spring, wherein the main spring is configured to be compressed within the tubular sock in response to the spring plate translating along the lead screw away from the spring rail, and to be de-compressed within the tubular sock in response to the spring plate translating along the lead screw toward the spring rail; and a divider having a plurality of cylinders, each cylinder receiving at least a portion of a separate one of the adjustable spring assemblies therein, with the tubular socks lining an inner surface of the cylinders.

2. The spring module of claim 1, wherein the tubular sock is a flexible fabric.

3. The spring module of claim 1, wherein the second end of the main spring abuts a closed end of the tubular sock.

4. The spring module of claim 3, wherein the tubular sock extends from the closed end about the main spring to an open end, wherein the open end is coupled to the motor.

5. The spring module of claim 4, further including an annular sock ring rigidly coupled to the motor, the open end of the tubular sock being coupled to the annular sock ring.

6. The spring module of claim 5, further including a load cell sandwiched between the annular sock ring and the stator, the load cell rigidly coupled to the stator and to the upper surface of the spring rail to suspend the motor in alignment with one of the apertures.

7. The spring module of claim 6, wherein a force carried by the adjustable spring assembly is transferred to the spring rail through the load cell.

8. The spring module of claim 4, wherein the tubular sock has a length extending from the closed end to the open end, the length remaining substantially the same when the main spring is compressed and de-compressed within the tubular sock in response to the spring plate translating along the lead screw.

9. The spring module of claim 8, wherein tension in the tubular sock increases as the main spring is compressed within the tubular sock and decreases as the main spring is de-compressed within the tubular sock.

10. The spring module of claim 9, wherein the tension holds the spring plate against rotation when the lead screw is rotating.

11. The spring module of claim 1, wherein the divider has a height extending upwardly from the spring rail, wherein the height of the divider is greater than a height of the lead screw.

12. A spring module for an adjustable sleeping system, comprising:

a spring rail that defines a length, a width, an upper surface, and a lower surface, the spring rail having a plurality of apertures extending between the upper surface and the lower surface along the length;

a plurality of adjustable spring assemblies spaced along the length of the spring rail;

each adjustable spring assembly comprises:

a motor with a stator and a rotor, the motor coupled to the spring rail in alignment with one of the plurality of apertures;

a lead screw coupled to the rotor and extending above the upper surface;

a spring plate coupled to the lead screw for translation along the lead screw away from the spring rail in response to rotation of the lead screw in a first direction and for translation along the lead screw toward the spring rail in response to rotation of the lead screw in a second direction opposite the first direction;

a main spring having a first end coupled to the spring plate, the main spring extending away from the spring plate to a second end opposite the first end; and a tubular sock covering the main spring;

a load cell rigidly coupled to the stator and to the upper surface of the spring rail, wherein the force carried by the spring assembly is transferred to the spring rail through the load cell; and a divider having a plurality of cylinders, each cylinder receiving at least a portion of a separate one of the adjustable spring assemblies therein, with the tubular socks lining an inner surface of the cylinders.

13. The spring module of claim 12, wherein the main spring is configured to be compressed within the tubular sock in response to the spring plate translating along the lead screw away from the spring rail, and to be de-compressed within the tubular sock in response to the spring plate translating along the lead screw toward the spring rail.

14. The spring module of claim 13, wherein tension in the tubular sock increases as the main spring is compressed within the tubular sock and decreases as the main spring is de-compressed within the tubular sock.

15. The spring module of claim 14, wherein the tension holds the spring plate against rotation when the leadscrew is rotating.

16. The spring module of claim 12, wherein the tubular sock has a closed end abutting the second end of the main spring.

17. The spring module of claim 16, wherein the tubular sock extends from the closed end about the main spring to an open end, wherein the open end is coupled to an annular sock ring rigidly coupled to an upper surface of the load cell.

18. The spring module of claim 17, wherein the tubular sock has a length extending from the closed end to the open end, the length remaining substantially the same when the main spring is compressed and de-compressed within the tubular sock in response to the spring plate translating along the lead screw.

19. The spring module of claim 17, wherein the lead screw extends through the sock ring.

20. The spring module of claim 12, wherein the divider is fixedly coupled to the spring rail and has a height extending upwardly from the spring rail, wherein the height of the divider is greater than a height of the lead screw.

21. The spring module of claim 12, wherein the motor is supported entirely by the load cell.

22. The spring module of claim 21, wherein the load cell has a stator connector rigidly coupled to the stator and a plurality of frame connectors rigidly coupled to the spring rail.

23. The spring module of claim 22, wherein the stator connector has a lead screw aperture sized for clearance receipt of the lead screw therethrough.

24. The spring module of claim 23, wherein the plurality of frame connectors includes a pair of frame connectors extending parallel to one another on diametrically opposite sides of the lead screw aperture, each of the frame connectors rigidly coupled to the spring rail to cancel out side loads imparted on the spring assembly.

25. The spring module of claim 22, further including a plurality of connecting arms coupling the stator connector to the plurality of frame connectors.

26. The spring module of claim 25, wherein the plurality of connecting arms deflect under load to allow the stator connector to move relative to the frame connectors, thereby allowing the motor to move relative to the spring rail.

27. The spring module of claim 26, further including a plurality of strain gauges configured to measure the magnitude of deflection of the connecting arms, with the magnitude of deflection correlating to a load carried by the spring assembly.

28. The spring module of claim 12, further including compliant inserts between adjacent main springs to counteract side loads imparted on the spring assemblies, thereby maintaining the adjacent main springs in a substantially upright orientation relative to the spring rail.

* * * * *